US005086798A

United States Patent [19]

Motts

[11] Patent Number: 5,086,798

[45] Date of Patent: Feb. 11, 1992

[54] VERSATILE KNEE REST WALKER

[76] Inventor: Glen Motts, 10195 Lisbon St., Louisville, Ohio 44641

[21] Appl. No.: 634,012

[22] Filed: Dec. 26, 1990

[51] Int. Cl.[5] ..... A61H 3/00

[52] U.S. Cl. ..... 135/67; 297/5

[58] Field of Search ..... 135/65, 67, 69, 68, 135/66; 297/5, 423; 272/70.3, 70.4, 114

[56] References Cited

U.S. PATENT DOCUMENTS

| | | | |
|---|---|---|---|
| 2,678,054 | 5/1954 | Bostelman | 135/68 |
| 2,778,370 | 1/1957 | Chamblee | 135/68 |
| 3,596,668 | 8/1971 | Tosto | 135/67 |
| 4,141,375 | 2/1979 | Tykwinski | 135/68 X |
| 4,187,869 | 2/1980 | Marchetti | 135/68 X |
| 4,291,715 | 9/1981 | Monte | 135/68 |
| 4,641,882 | 2/1987 | Young | 297/5 X |
| 4,722,356 | 2/1988 | Rehder | 135/67 |

FOREIGN PATENT DOCUMENTS

| | | | |
|---|---|---|---|
| 544730 | 8/1957 | Canada | 135/69 |
| 7400053 | 7/1975 | France | 135/67 |
| 2185716 | 7/1987 | United Kingdom | 135/67 |

*Primary Examiner*—David A. Scherbel
*Assistant Examiner*—Lan Mai
*Attorney, Agent, or Firm*—Low & Low

[57] ABSTRACT

A versatile knee rest for invalid walkers which is easily adapted to existing walkers or provided as original equipment wherein the knee rest may be quickly and readily positioned on either the right side or left side of the walker as required by the user. While of simple construction, the knee rest is ruggedly mounted and braced for use.

11 Claims, 3 Drawing Sheets

VERSATILE KNEE REST WALKER

BACKGROUND OF THE INVENTION

Hand-held ambulatory aid devices for invalids, commonly known as "walkers", have been extant in the medical and orthopedic aid arts for many decades. The same have been refined in design, strength, reliability, and relatively low cost, whereby such walkers are readily available to any person needing such support in seeking to be ambulant.

Only limited efforts and concern, however, have been directed to the useful provision of knee rest means with the walker, so that the user may conveniently and at any time, whether while standing or while in motion, be able to rest either the right or the left knee on a walker-mounted support, thereby easing any discomfort or weariness in the leg or otherwise rest the limb or portion thereof.

While attempts have been made to provide such attachments for walker devices, as attested by illustrative U.S. Pat. Nos. to Rehder 4,722,356; Tosto 3,596,668; or Marchetti 4,187,869, among others, the same are inordinately complex, expensive, and not readily utilizable for either right-or left-knee use.

BRIEF SUMMARY OF THE INVENTION

In accordance with my invention, a highly versatile yet simple knee rest is provided for an invalid walker, which is readily adaptable to almost any extant walker, which is easily mounted for either right of left knee usage, which is structurally strong and reliable.

The knee rest includes a planar knee rest panel, which is preferably cushioned or padded for comfort, and which is symmetrical in outline, thereby to adapt readily to either a right or left knee mounting on a walker.

The knee panel receives selectively along its right or left longer side on the bottom a leg member of L-form, with the longer leg secured as by bolts to the underside of the rest panel. The generally vertical leg includes extension means, thereby to accommodate the knee rest to the particular walker, wherein the same are commonly provided with leg height adjustments. The ground leg may be cushion-tipped in the usual manner.

Preferably, the ground leg portion engages the ground at a position slightly forward of the rear legs of the walker, thereby enhancing stability in use. This is accomplished by the generally right-angle relationship of the leg member portions, and wherein conventionally the legs and especially the rear legs of the walker incline slightly forward at a few degrees of angle.

The final element of the simple assembly is that transverse brace extending between and secured to the knee rest leg and the adjacent left or right walker leg, thereby providing a rigidified structure.

The knee rest is quickly shifted from the right to the left, or vice versa, as required by a user by merely connecting the L-form leg member along the other side of the knee rest panel and connecting the brace in reverse or mirror image manner.

Accordingly, the knee rest of the invention proves itself highly versatile, yet mechancially simple and reliable, adaptable to present walkers with little difficulty, while also being available as original accessory equipment for invalid walkers particularly adapted to use the rest.

BRIEF DESCRIPTION OF THE DRAWINGS

The invention will be better understood in reference to the accompanying drawings, in which.

DESCRIPTION OF A PREFERRED EMBODIMENT

Figure 1:
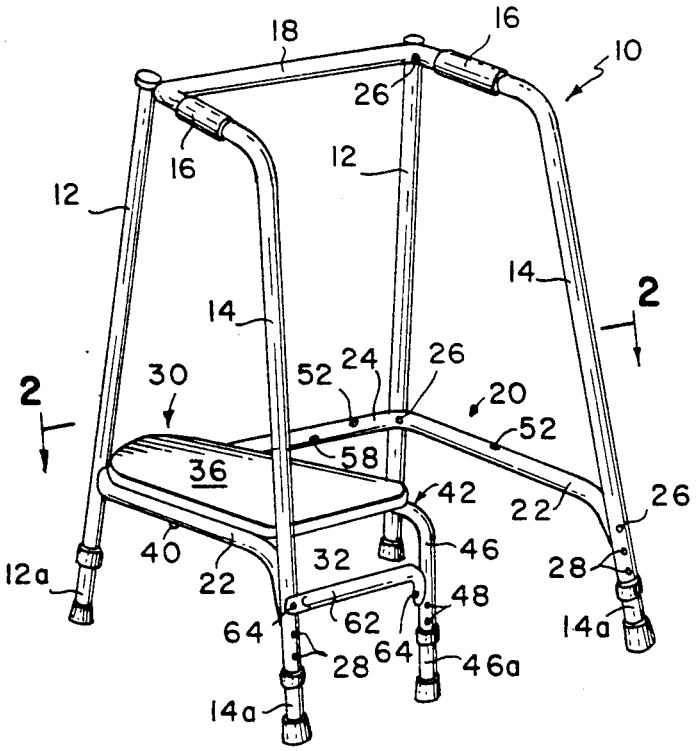
FIG. 1 is a perspective view of a conventional invalid walker showing the knee rest of my invention secured thereto for use in the left-hand postion.

Referring to the drawings, a generally conventional invalid walker 10 is formed from tubular material, as aluminum, and includes forward legs 12, rear legs 14, hand grips !6, forward brace 18 and lower U-brace 20 including rear leg brace portions 22 and transverse forward brace portion 24, together connecting all the legs in usual manner, as by bolts or rivets as at 26. As shown, the rear legs 14 are formed integrally as a single piece of tubing extending through the handgrips 16 and as the front brace !8, to which the forward legs are connected at the top as by bolts or rivets. Obviously, differing forms of fabrication may be provided for the walker as well known in the art.

It is only required for the invention herein that the walker lower brace 20 include at least one, and preferably two portions to provide support for the knee rest, as noted further hereinafter.

In usual manner also, as is well known, the legs 12, 14 of walker 10 are provided with telescoping terminal portions **12*a* and 14*a* to permit limited height adjustability for the user, wherein the terminal portions 12*a* and 14*a* may be vertically positioned at a selected height and secured in adjusted position by spring detents cooperating with vertically spaced apertures on the legs, as shown at 28** on the rear legs.

Cooperatively associated with and forming part of walker 10 is the knee rest assembly 30 of my invention. As indicated hereinabove, the same essentially comprises the knee rest panel 32 which is a substantially planar and rigid member of sufficient strength to accommodate the weight and forces normally encountered in use. The panel may consist of merely a rigid member of plywood or plastic 34, but preferably includes a top cushioning layer 36 of suitable material, as polyurethane foam. Also, the panel 32 is preferably covered and enclosed by a sheet or web of fabric or plastic 36 to enhance the appearance thereof as well as provide ready washability.

Figure 2:
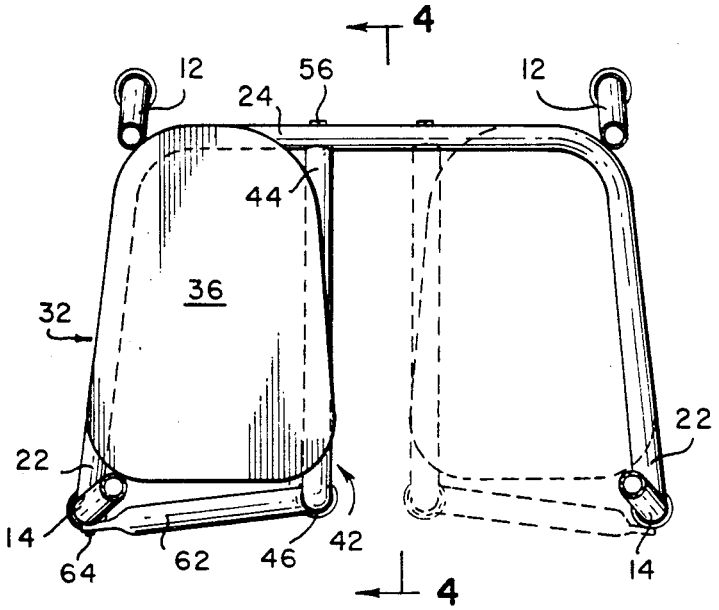
FIG. 2 a top plan view, partly in section, taken on the line 2—2 of FIG. 1, also showing in phantom the position of the knee rest when used in the right-hand position.

As is evident from the drawings and particularly FIG. 2, the knee panel 32 is generally trapezoidal with the larger width disposed toward the rear to maximize support for the knee or leg of the user. Further, the corners of the knee panel are radiused or curved to as to provide clearance for the respective front and rear legs 12, 14 when the knee rest is in either its right or left hand position.

Figure 3:
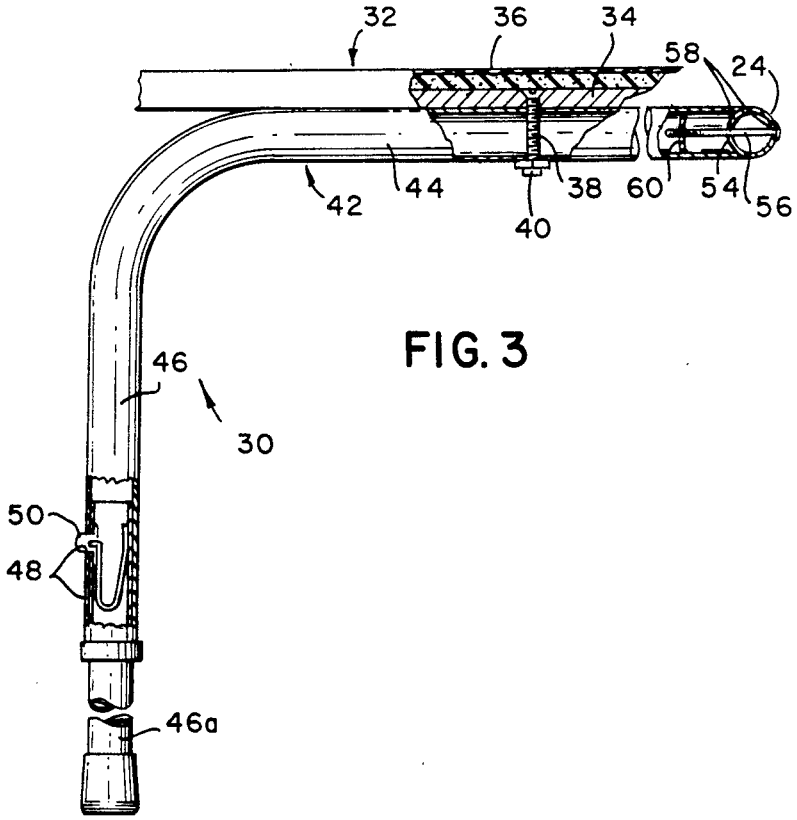
FIG. 3 is a side elevation, partly in section and broken away of my knee rest.
Figure 4:
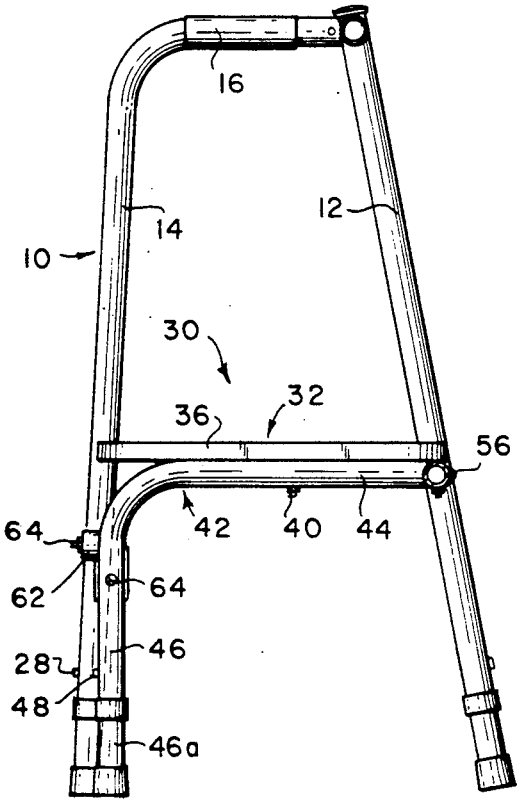
FIG. 4 is a side elevation, partly in section, taken generally on the line 4—4 of FIG. 2.

The panel 32 is secured, as by one or more bolts 38 and cap nuts 40 as seen in FIG. 3 to the horizontal portion 44 of an L-shaped leg member 42 formed in suitable manner, as by a bent tubular metal extrusion. The vertical leg portion 46 is at substantially right angles to the panel-connected portion 44, and includes a lowermost telescoping terminal portion 46*a* received therewithin and adjustably secured at a desired position as by spring detent 50 carried by the terminal leg 46*a* and extending through a selected aperture 48 in leg portion 46, in a manner similar to that of walker 10 .

While as shown, the bolt 38 is bonded to or otherwise secured to adjacent the rigid member 34, as in a countersink thereon, in like manner, a nut or cap bolt as at 40 may be positioned and held against member 36 and a bolt threaded upwardly thereinto.

In FIGS. 2 and 3 it will be seen that the leg member 42 is bolted to the right side of the knee rest 32. The knee rest is also provided with recessed nuts or like means on the left side thereof as viewed from above, whereby the panel is stabilized by being bolted through apertures 5 in the fore-to-aft leg braces 22 thereby to secure the panel thereto as by a cap nut 40 on the brace 22. For maximum rigidity and security, a like fastening means is provided at the forward end of the panel 32 for similar securement through a like aperture 52 in the lower forward brace portion 24.

Additionally, as seen in FIG. 3, the forward end of leg 42 is arcuately cut at 54 to complementarily fit the curvature of front tubing brace 24, and is secured rigidly thereto by conventional means as an elongated bolt 56 extending horizontally through apertures 58 of front brace 22, connecting to an expanding clamping nut 60 within the leg.

The panel 32 and leg 42 are further rigidified by a short tubular rear brace 62 extending between the vertical knee rest leg 46 and the adjacent rear walker leg 14, and suitably connected thereto as by nut and bolt connections 64. To simplify fabrication, the connection to the walker leg 14 may be the same as that used for the walker side brace 22.

As a consequence, the knee rest 30 provides an exceptionally rugged adjunct structure to the walker, rigidly connected thereto by at least three points by nut and bolt connections.

Figure 5:
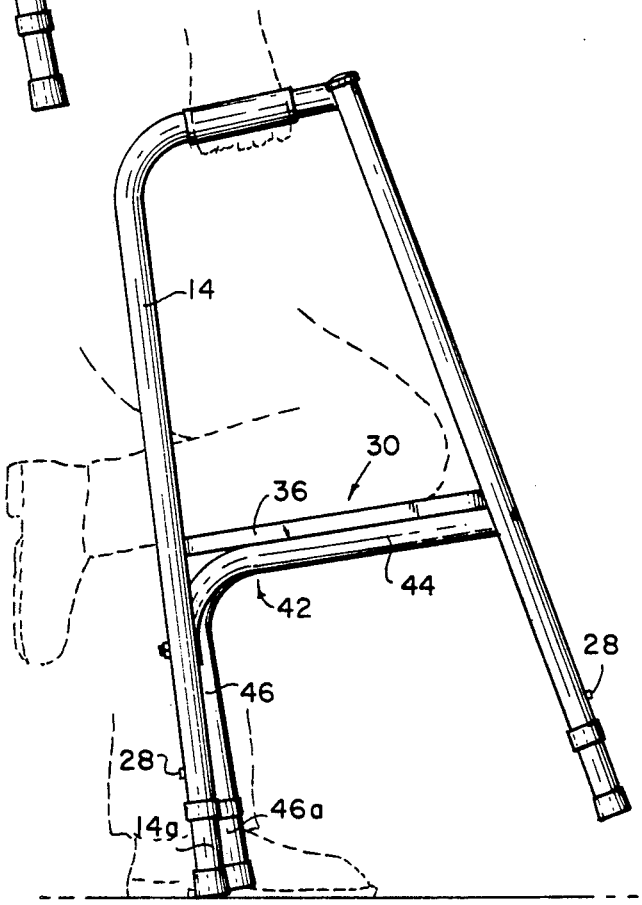
FIG. 5 is an illustration of the knee rest in use.

As indicated, the leg 46 of the knee rest is substantially vertical, while the rear legs 14 of the walker are slightly inclined forwardly, as is evident from the drawings. This provides a stability benefit on any slightly irregular surface as the three legs are not in a straight line across the back of the walker, and there is reduced likelihood of tipping or rocking. The two rear legs will engage the ground surface as usual, which the slightly forward knee rest leg will be slightly relatively elevated at first rear leg contact, as indicated in FIG. 5, while yet ensuring positive support for the knee rest as required.

Figure 6:
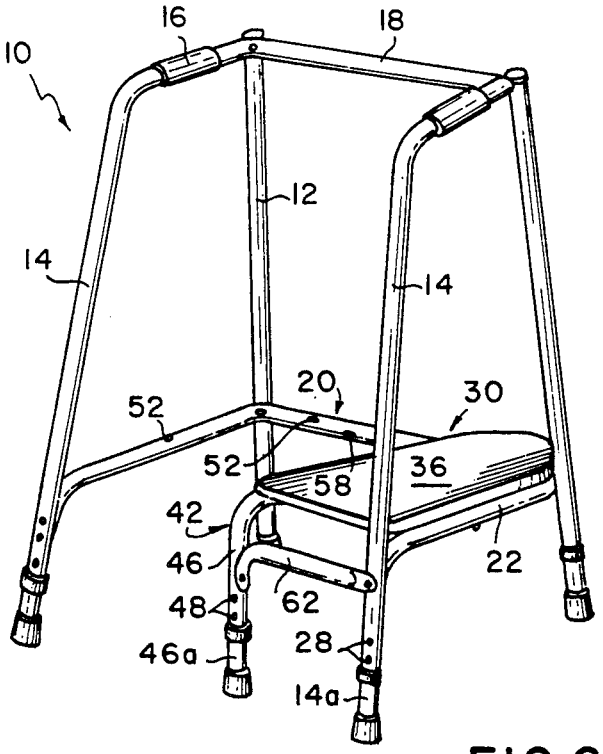
FIG. 6 is a view similar to FIG. 1 but showing the knee rest assembly mounted for right knee use.

As disclosed, the knee rest 30 may be easily relocated from one side to the other, as seen in comparing FIGS. 1 and 6. In so doing, the L-leg 42 of the rest is unbolted from the right edge of the knee panel 32 and resecured to like connections on the left edge. Similarly, the front bolt 56 secured to the horizontal leg portion 44 is loosened, and resecured to the leg through a like aperture 58 on the right side of front cross brace 24. Finally, and easily, the rear brace 62 is unbolted from left rear walker leg 14 and from knee rest leg 46, reversed through 180° , and refastened to the members as shown.

The knee rest 30 may be provided as original equipment to an invalid walker or line of walkers, with the bolt attachment apertures preformed through the walker brace 20, or, as is evident, the knee rest assembly of the invention may be quickly adapted to an existing walker by the simple expedient of drilling bolt holes through comparable walker brace members 20 to accommodate the same.

While I have disclosed a preferred form of my invention, it is understood that the specific configuration and fabrication thereof may depart from that shown while still embracing the invention within the scope thereof as defined in the appended claims.

What I claim:

1. A versatile knee rest invalid walker comprising, a pair of spaced-apart rear legs and spaced-apart front legs in front of said rear legs defining together opposite sides between which a user may stand, and means for a user to grip the walker in use, a rest for a knee or the like, means removably securing said knee rest to said walker between the said sides thereof and adjacent the selected side thereof corresponding to the leg of the user requiring the rest, and, depending leg means for supporting the rear portion of said rest, said leg means being secured to said rest in spaced relation to the adjacent rear leg of the selected side of the walker.

2. The versatile knee rest of claim 1 further including a rear brace member detachably secured to and between said leg means and said selected adjacent walker rear leg.

3. The versatile knee rest of claim 1 wherein said rear leg means is spaced forwardly of said walker rear legs, whereby, during use by a user in walking, said rear legs engage the ground prior to said knee rest leg means thereby avoiding instability of said walker on irregular surfaces.

4. The versatile knee rest of claim 1 wherein said rest includes means for detachably securing said leg means thereto.

5. The versatile knee rest of claim 4 wherein said last named means is disposed on both the right side and the left said of said knee rest.

6. The versatile knee rest of claim 1 wherein said walker includes a front transverse brace extending between said front legs, and said securing means includes means for detachably connecting said knee rest to said front brace.

7. The versatile knee rest of claim 1 wherein said walker includes side braces extending between said front legs and said rear legs on each side, and said securing means includes means for detachably connecting said knee rest to a said side brace.

8. The versatile knee rest of claim 1 wherein said walker includes a front transverse brace extending between said front legs, and side braces extending between said front legs and said rear legs on each side, and said securing means includes means for detachably connecting said knee rest to said front brace and a said side brace.

9. The versatile knee rest of claim 1 wherein said rest is substantially trapezoidal in plan with a wider portion thereof toward the rear of said walker to maximize the area of engagement with a user's leg, said rest being substantially symmetrical about its fore-and-aft axis to facilitate its selective disposition o either side of said walker.

10. The versatile knee rest of claim 9 wherein said rest includes rounded corners to provide clearance with respect to said walker front and rear legs.

11. A versatile knee rest walker comprising:

spaced-apart rear legs between which a user may stand and spaced-apart front legs cooperatively associated therewith, U-shaped means at the upper ends of said legs defining a transverse front brace and hand grip areas along the sides thereof extending between said front and rear legs, a U-shaped member spaced vertically above the bottoms of said legs having a middle portion extending transversely between said front legs and connected thereto and opposite end portions extending between said front and rear legs and connected to said rear legs thereby to brace said walker, a support for a user's knee or the like resting upon said U-shaped member, said support having ground-engageable means carried thereby, means selectively securing said support and said ground-engageable means carried thereby to one or the other of said end portions of said U-shaped member depending upon the knee to be supported when the walker is in use, whereby said knee support is respectively selectively connected to either of said U-shaped end portions and also supported by said ground-engageable means carried thereon.

* * * * *